US005657774A

United States Patent [19]

Niese

[11] Patent Number: 5,657,774

[45] Date of Patent: Aug. 19, 1997

[54] HAIRPIECE KIT HAVING A HEADBAND

[76] Inventor: Mary Ellen Niese, 1516 Bay Area Blvd. R4, Houston, Tex. 77058

[21] Appl. No.: 592,496

[22] Filed: Jan. 26, 1996

[51] Int. Cl.[6] ..... A41G 5/00

[52] U.S. Cl. ..... 132/54; 132/53; 132/56; 132/201; 132/105

[58] Field of Search ..... 132/53, 54, 56, 132/201, 105; 2/174, 207

[56] References Cited

U.S. PATENT DOCUMENTS

| | | | |
|---|---|---|---|
| 1,714,358 | 5/1929 | Finkelstein | 132/105 |
| 3,385,305 | 5/1968 | Buzzelli | 132/105 |
| 3,434,481 | 3/1969 | Mazzocco | 132/53 |
| 4,254,783 | 3/1981 | Kim | 132/105 |
| 4,745,933 | 5/1988 | Soenger | 132/53 |
| 4,825,886 | 5/1989 | Allen | 132/53 |
| 4,966,173 | 10/1990 | Russell | 132/54 |
| 5,337,763 | 8/1994 | Harber et al. | 132/53 |

*Primary Examiner*—Gene Mancene
*Assistant Examiner*—Philogene Pedro
*Attorney, Agent, or Firm*—Maryam Bani-Jamali

[57] ABSTRACT

This invention features a hairpiece kit having a hairpiece and a headband. The hairpiece comprises a flexible net lace cap and wefts of hair attached to and extending out from top of the net lace cap. The net lace cap is preferably semi-oval shaped with a straight front edge positioned near the forehead of the wearer, with a curved back edge positioned near the crown of the head of the wearer and with a central axis being perpendicular to the front edge of the net lace cap and running from crown of the head to forehead of the wearer. In a most preferred embodiment, the hairpiece is connected to the headband by using strips of attaching material that are attached onto top of the headband and onto bottom of the hairpiece, a hook strip and a loop strip respectively, simplifying separation of the hairpiece from and attachment of the hairpiece to the headband and diminishing costs. The strips of attaching material may be connected to the headband and to the hairpiece by sewing. The headband extends from above one ear to above the other ear of the wearer, leaving any space behind the ears of the wearer free. The headband has narrower ends above the ear and a wider central section. The hairpiece can be easily attached onto a hook strip connected to and resting on top of a headform for storing and styling.

12 Claims, 7 Drawing Sheets

FIG. 1a
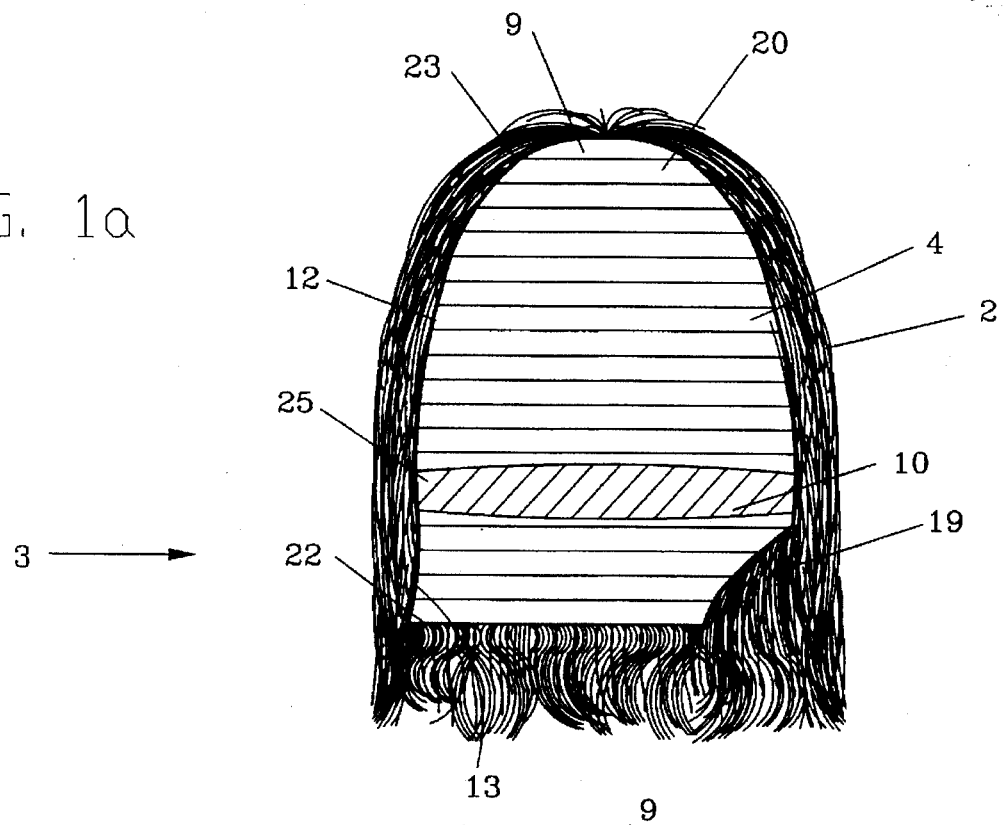
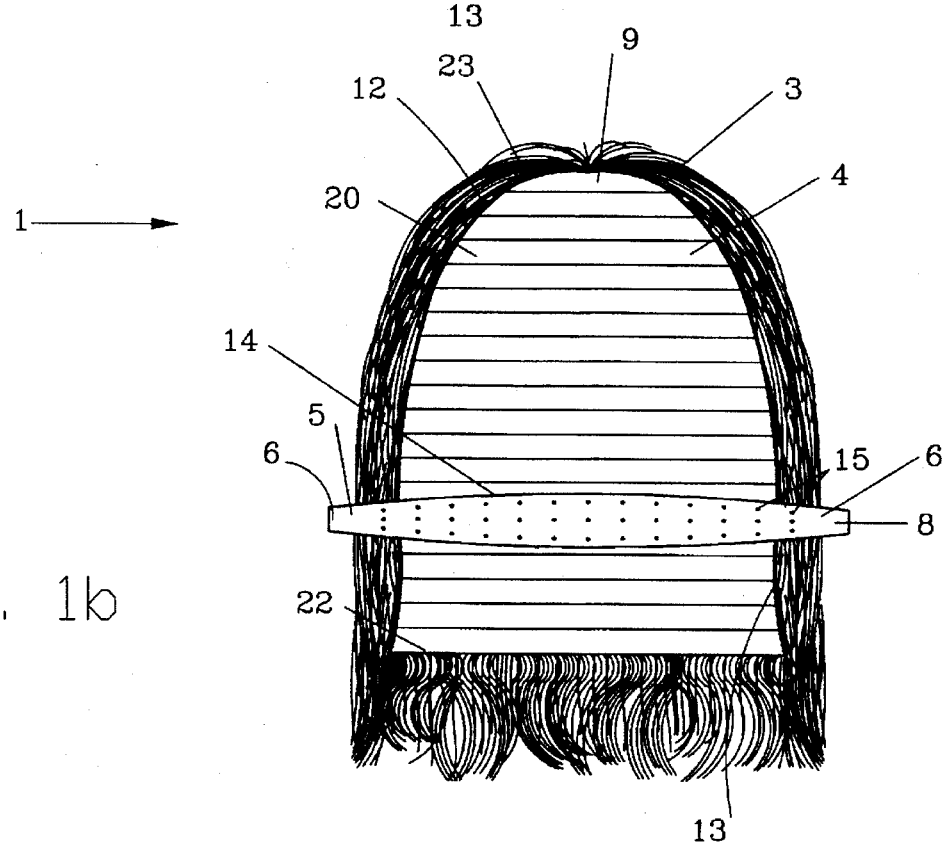
FIG. 1b

HAIRPIECE KIT HAVING A HEADBAND

BACKGROUND OF THE INVENTION

1. Field of the Invention

This invention relates to a hairpiece kit comprising a hairpiece attached, without requiring any hair pins or adhesives, to a headband by joining loop material connected to the hairpiece to hook material connected to the headband. The headband, having gripping teeth on its bottom side, is used for tightly securing the hairpiece on the head of the wearer and extends from above one ear to above the other ear.

2. Description of the Prior Art

Different versions of hairpieces have emerged in the past decades. Hairpieces have been applied to supplement the length or thickness of the hair of the wearer. Full-head wigs, wiglets and hair add-ons have been regularly used as hairpieces. The wigs and wiglets that have been available in the market have several disadvantages. Most wigs and wiglets designed for the general market are not custom-made to fit the head or hair style of each wearer. An ill-fitting wig or wiglet tends to slide on the head of the wearer and, therefore, it may be necessary to pin the wig or wiglet, or to attach the wig or wiglet with combs, to the natural hair of the wearer to secure the hairpiece in place. Unfortunately, many wearers who use wigs and wiglets have lost so much of their natural hair that, using pins and/or combs, wigs and wiglets may not be comfortably worn. Moreover, many wigs and wiglets can provide only one appearance. Thus, more than one wig or wiglet is required to achieve different appearances and a wig or wiglet does not blend with the hair of the wearer to achieve different styles.

Another type of hairpiece is formed by attaching artificial hair to a comb-like structure and then anchoring the artificial hair into existing natural hair. A disadvantage of this type of hairpiece is that any forces generated either by the weight of the artificial hair itself or by outside forces applied to the strands of artificial hair will cause a net force on the comb tending to pull the tangs of the comb free from the existing natural hair by rotating the comb about a pivot point formed by the free ends of the comb tangs.

In addition, a large number of patents have been issued which have attempted to solve one or more of the above issues or some other similar problems related to artificial hairpieces. A summary of some of the more relevant of said patents follow.

Haber et al., U.S. Pat. No. 5,337,763, registered on Aug. 16, 1994, patents a multi-use hairpiece kit. The hairpiece kit includes a support to extend from behind one ear to behind the other ear of a wearer while conforming to the shape of the head of the wearer. The hairpiece kit includes a hairpiece having flexible base and being used to cover a portion of the head of the wearer. Hair strands are attached to and extend outwardly from one side of the base. Using a sleeve, the hairpiece is removably attached to the support and conforms to the shape of the support.

Russell, U.S. Pat. No. 4,966,173, issued on Oct. 30, 1990, patents a hairpiece for compensation of hair loss. The hairpiece includes a band of resilient material in shape of an arc to conform to head of a user, and a foundation member to which hair is attached. The foundation member is placed over an area of hair loss or hair removal to conceal the area.

Saenger, U.S. Pat. No. 4,745,933, issued on May 24, 1988, discusses a method and apparatus for securing hairpieces to a wearer's head. A foundation cap, comprising nylon-like stretch material and having a closed rounded end, is used to securely hold a wig in place on the wearer's head. A circular skirt of similar nylon-like stretch material is located at about the midpoint of the foundation cap. If necessary, filler material is inserted into the cap and/or an elastic band housing a pre-rolled filler is first placed over the head to hold the foundation cap in place.

Kim, U.S. Pat. No. 4,254,783, was issued on Mar. 10, 1981. Kim patents a hairpiece having a comb-shaped attaching member. Artificial hair roots are attached to the comb-shaped attaching member at a plurality of evenly dispersed and disconnected hair root attaching sites formed on one side of the comb-shaped member. The comb-shaped member may be formed with a spring wire core coated with a thermoplastic material which also serves to anchor the artificial hair roots.

It would be advantageous to design a hairpiece kit for covering areas of hair loss, as well as for supplementing the length or thickness of the hair of the wearer, while avoiding movement and displacement of the apparatus and while providing various hair styles in one hairpiece kit of relatively low cost.

SUMMARY OF THE INVENTION

A primary object of the present invention is to provide a hairpiece kit used for cosmetic enhancement of a wearer by covering any areas of hair loss and by supplementing the length or thickness of the hair of the wearer.

Another object of the present invention is to design a hairpiece kit that can be worn by a wearer having little or no natural hair or fine, thinning natural hair.

Still another object of the present invention is to provide a hairpiece kit that can be securely placed on head of a wearer without using hair pins or adhesives.

A further object of the invention is to design a hairpiece kit with a headband to which a hairpiece is removably attached.

An additional object of the present invention is to provide a simple, easily applied headband which is adapted to securely hold a hairpiece and to minimize slippage of the hairpiece.

A further object of this invention is to provide versatility of styles of hairpiece that can be used with one headband.

Another object of the present invention is to design a hairpiece kit that is comfortable and convenient to use and that is convenient to store when not in use.

An additional object of the present invention is to provide a hairpiece kit that creates a natural look and that can blend easily with any hair of a wearer.

A final object of the invention is to design a hairpiece kit of low cost.

Additional objects and advantages of the invention will be set forth in part in a detailed description which follows, and in part will be obvious from the description, or may be learned by practice of the invention.

The present invention defines a hairpiece kit having a hairpiece with a top side and a flexible bottom side and a headband with a top side and a bottom side. The hairpiece comprises a flexible net lace cap serving as a base for any natural or artificial hair and having a front edge, a back edge, a top side and a bottom side. The from edge of the net lace cap is wider than the back edge of the net lace cap. The bottom side of the hairpiece comprises the bottom side of the net lace cap and a strip of attaching material, preferably Velcro material. Wefts of hair extend out from the top side of the net lace cap. The top side of the headband is attached by means of a strip of attaching material, preferably Velcro material, to the bottom side of the hairpiece, and thus, to the bottom side of the net lace cap. The use of a strip of attaching material on the top side of the headband and on the bottom side of the hairpiece eliminates any need to sew the hairpiece to the headband or to use adhesives, tapes, clips, pins, combs or any other similar material presently used for fixing hairpieces on the head of a wearer. The headband fits over the head of the wearer, extending from just above one ear to just above the other ear, thus leaving any space behind the ear for eyeglasses and being more comfortable. The headband is designed to have narrower ends while having a wider central section which serves as top of the headband when the headband is positioned on the head of the wearer. Hook strips of the attaching material may be sewn onto the top side of the headband. Sewing of the attaching material onto and on the top side of the headband provides a more secure hold than use of adhesives, tapes, clips, pins or combs does. Gripping teeth are used on the bottom side of the headband in order to more stably hold the hairpiece on the head of the wearer. As a result, the furnished headband is durable, has a neat appearance and holds the hairpiece more tightly and stably.

The hairpiece of the present invention is unique in several aspects. Previously used wiglets are mostly round-based. In contrast, the base of the present hairpiece (i.e. the net lace cap) is in the shape of a semi-oval with a straight edge and fits an area between the hairline and the crown. Said semi-oval base has a central axis that is perpendicular to its straight edge, with the central axis running from crown of the head of the wearer to forehead of the wearer. The base of the hairpiece is particularly designed to have unhemmed, loose edges, as opposed to curled, finished edges of previously existing wigs and wiglets. In a preferred embodiment, lace ribbons extend out from the net lace cap, providing an increased and a more spread-out base. Wefts of hair may be attached to said lace ribbons, resulting in a more natural-looking wig and more evenly-distributed wefts of hair. Thus, the hairpiece fits more naturally on the head of the wearer and allows hair strands to blend better with hair style of the wearer. With a loop strip of attaching material, preferably Velcro material, sewn to the bottom side of the hairpiece and a matching hook strip of attaching material sewn to the top side of the headband in a preferred embodiment, the hairpiece is tightly secured by the headband. Therefore, chances of the hairpiece slipping or unwantedly separating from the headband are minimized. Meanwhile, separation of the hairpiece from the headband is simply done by pulling the hairpiece away from the headband. The removed hairpiece can be replaced at any time by another hairpiece. Improved blending of the hair of the wearer with the hair of the hairpiece and quick and simple replacement of the hairpiece by another hairpiece allow for naturalness of look of the wearer and for versatility of styles available to be used by the wearer.

In addition, the hairpiece can be stored on a headform. In the past, wigs and wiglets have been stored by using pins to secure the wig or wiglet to a headform. When pins are used to secure the wigs and wiglets, shape of the wigs and wiglets can be distorted and combing, brushing and styling of the wiglets are more difficult and time-consuming. Using the hairpiece kit, a hook strip of attaching material, preferably Velcro material, is attached to and rests on top of the headform. The hook strip of the headform is preferably about 4 inches long. The hairpiece, having been removed from the headband, can be attached to the hook strip of attaching material of the headform so that the hairpiece will not slip from the headform during styling and storing.

It is to be understood that the descriptions of this invention are exemplary and explanatory, but are not restrictive, of the invention. Other objects and advantages of this invention will become apparent from the following specification and from any accompanying drawings, charts, tables and examples that follow.

BRIEF DESCRIPTION OF DRAWINGS, CHARTS, TABLES AND EXAMPLES

Any accompanying drawings, charts, tables and examples which are incorporated in and constitute a part of this specification, illustrate examples of preferred embodiments of the invention and, along with the description, serve to explain the principles of the invention.

FIG. 1*a* is a bottom view of a hairpiece, with an edge of the hairpiece turned around and with a loop strip attached to the hairpiece; FIG. 1*b* is a bottom view of the hairpiece of FIG. 1*a* removably attached to a headband by using hook and loop material;

FIG. 1*c* illustrates a bottom view of a hairpiece having lace ribbons, with side hair of the hairpiece excluded to more clearly demonstrate the lace ribbons; FIG. 1*d* illustrates the bottom view of the hairpiece of FIG. 1*c* removably attached to a headband by using hook and loop material.

FIG. 2*a* illustrates a top view of the headband of FIG. 1*b* when the hairpiece has been removed, showing a hook strip attached to the headband; FIG. 2*b* is a bottom view of the headband of FIG. 2*a*, showing a number of rows of gripping teeth attached to bottom side of the headband.

DETAILED DESCRIPTION OF THE PREFERRED EMBODIMENT

Preferred embodiments of the present invention are illustrated in any drawings and examples that follow.

Figure 1C:
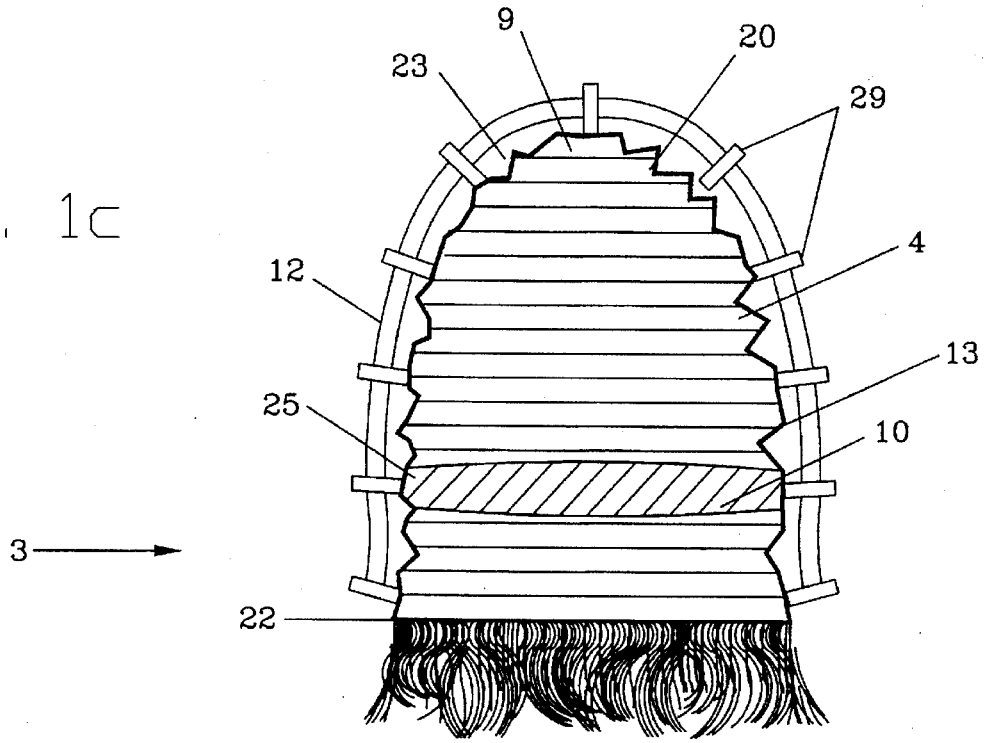
Figure 1D:
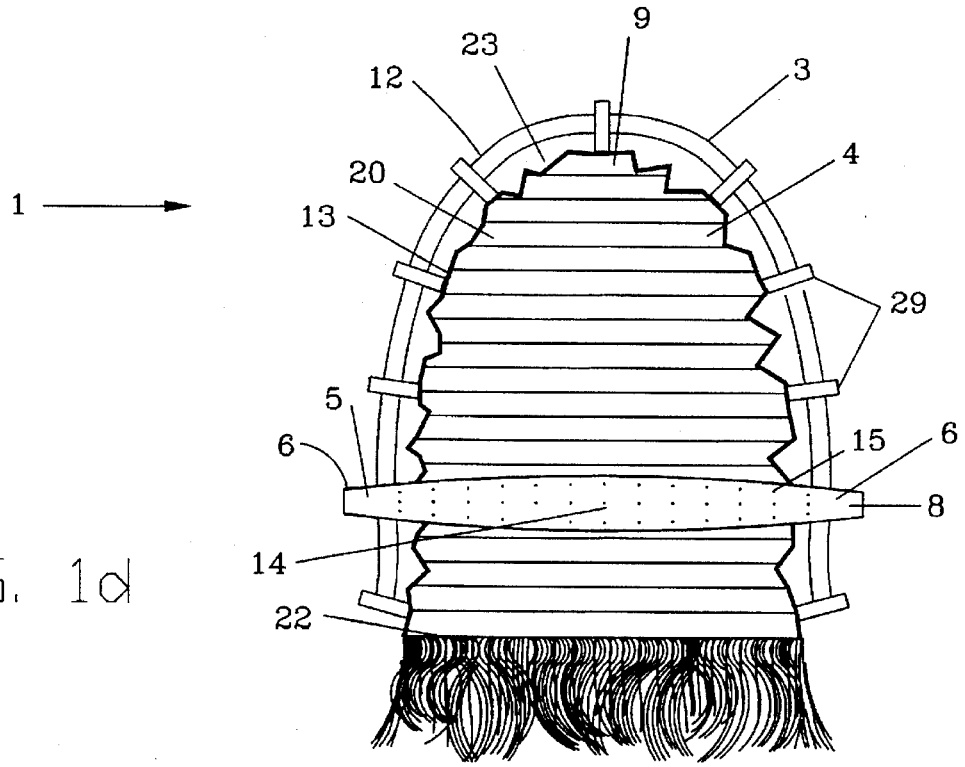
Figure 2A:
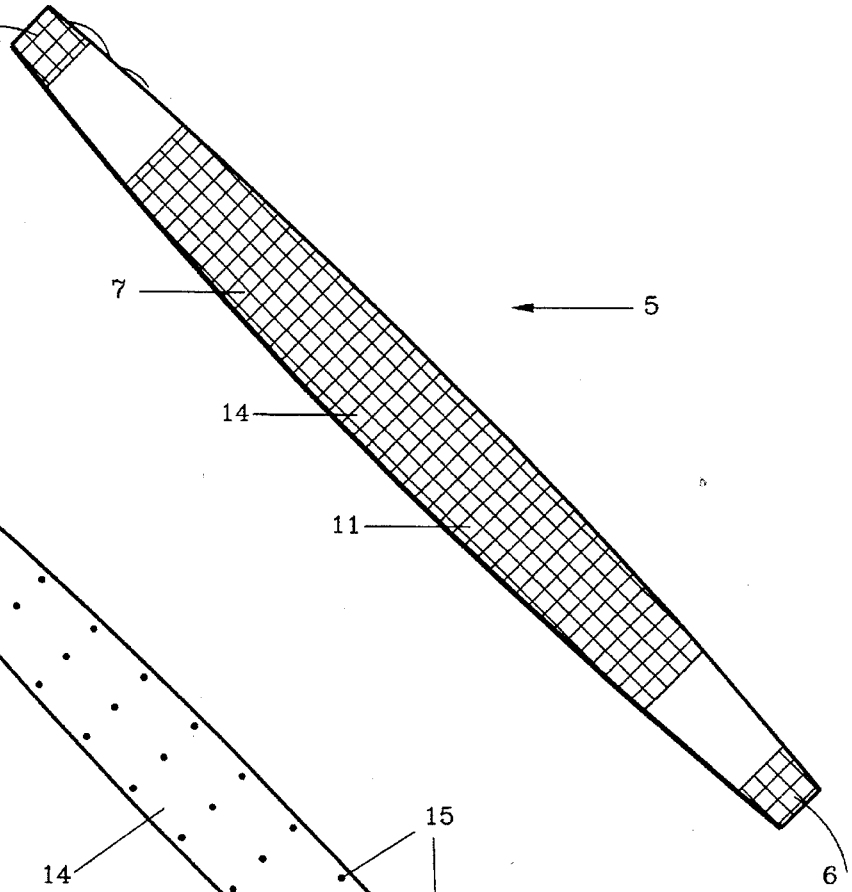
Figure 2B:
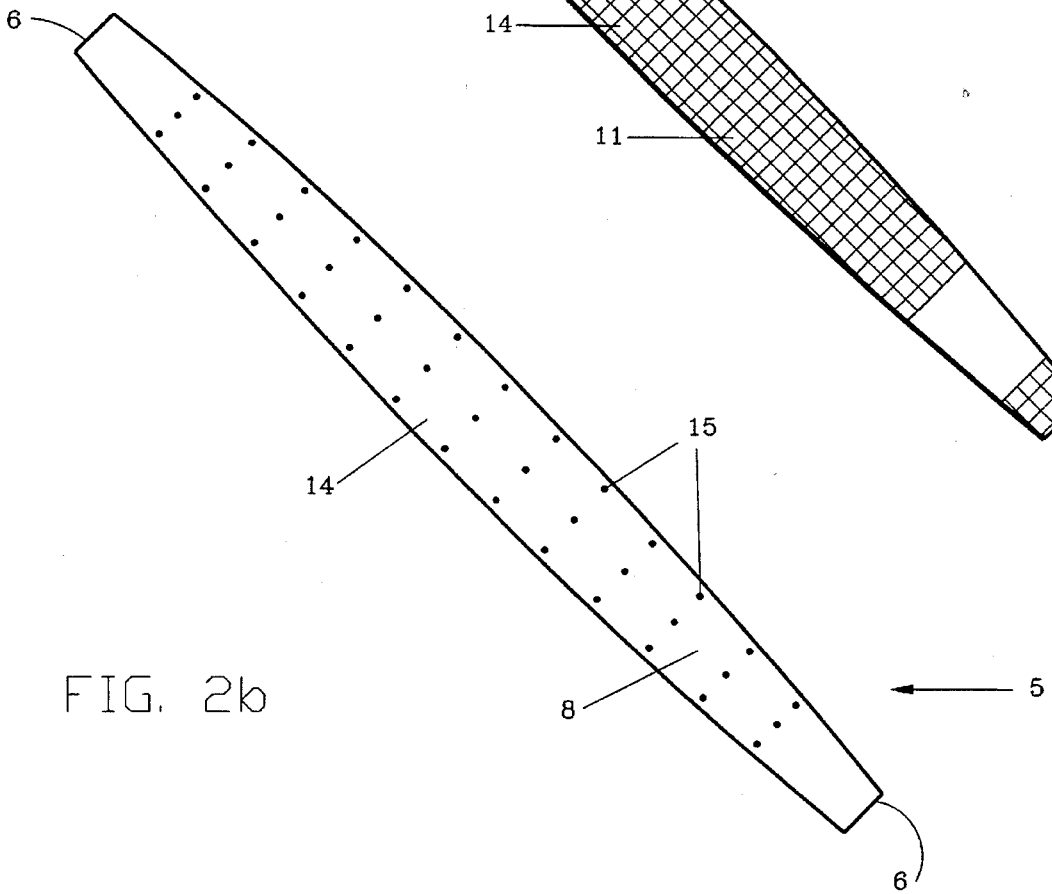
Figure 3:
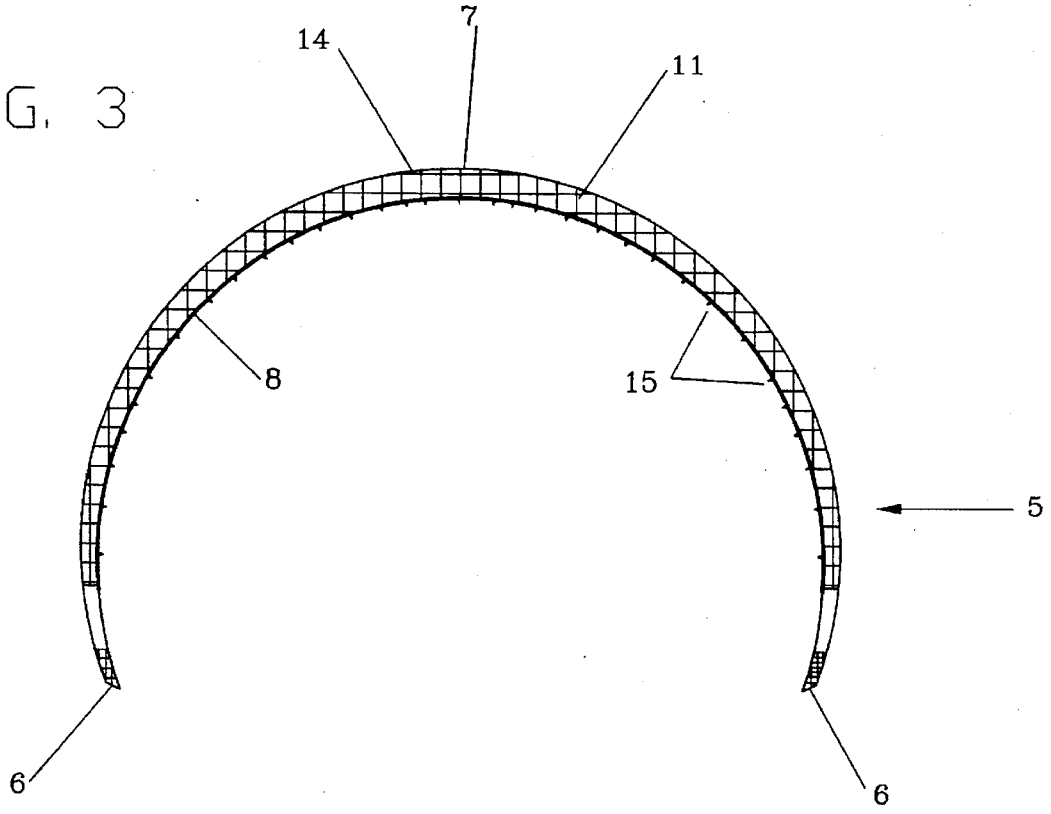
FIG. 3 is a perspective view of the headband of FIG. 2*a* when the headband is curved.
Figure 4:
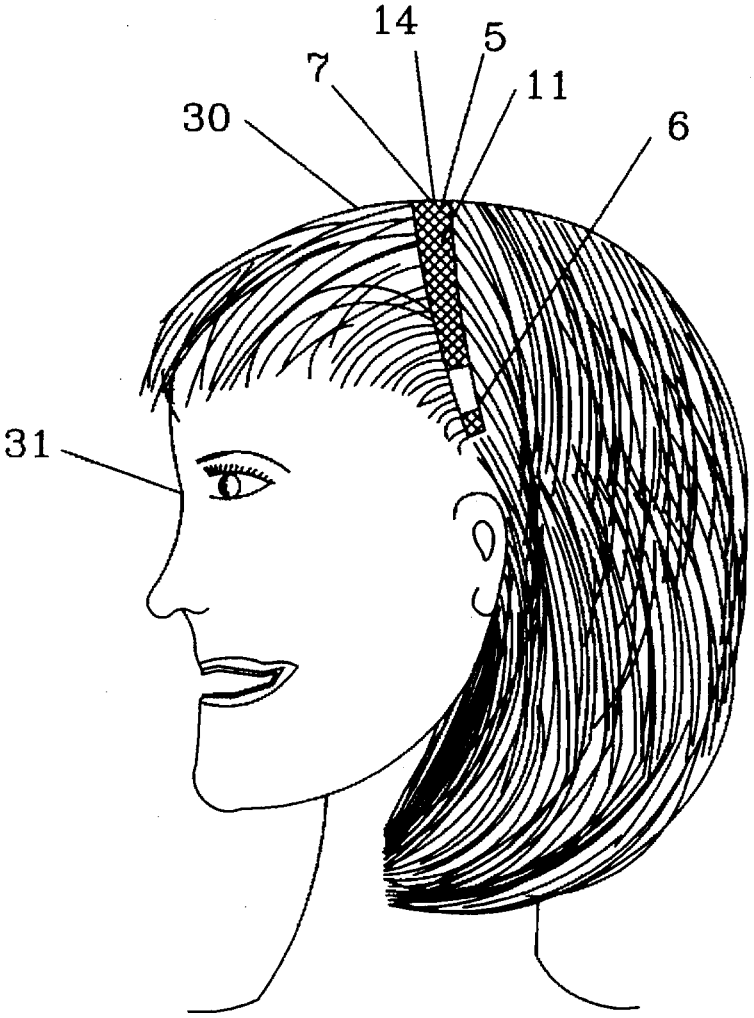
FIG. 4 is a schematic side view of the headband of FIG. 2*a* that is being worn by a wearer.

The present invention defines a hairpiece kit 1 for a wearer of hairpieces. As shown in FIG. 1*a*, FIG. 1*b*, FIG. 1*c*, FIG. 1*d*, FIG. 2*a*, FIG. 2*b*, FIG. 3 and FIG. 4, the hairpiece kit 1 comprises a hairpiece 3 and a flexible headband 5, said headband 5 having two opposite ends 6. The hairpiece 3 is positioned on top of head of the wearer 31 and is styled to match the hairstyle of the wearer. The hairpiece 3 of the present invention is unique in several aspects. Previously used bases of wigs and wiglets are mostly round. In contrast, the present hairpiece 3 has a net lace cap 9 as base and is preferably in the shape of a semi-oval with a straight edge (refer to FIG. 1*a*, FIG. 1*b*, FIG. 1*c* and FIG. 1*d*), fitting an area between the hairline and the crown. The base of the hairpiece 3 is preferably designed as a net lace cap 9 to have unhemmed, loose edges, as opposed to curled, finished edges of previously existing wiglets. Thus, the hairpiece 3, with its loose construction, fits more naturally on the head of the wearer 31 and allows hair strands to blend more easily with hair style of the wearer. Hair strands may be attached in different quantities and directions to the net lace cap 9 depending upon the style of hair desired. Flexible lace ribbons 29 may be used to extend out from the net lace cap 9 in order to provide an increased and a more spread-out base. (Please refer to FIG. 1*c* and FIG. 1*d*.) Wefts of hair 12 may be attached to said lace ribbons 29 resulting in a more natural-looking wig, more evenly-distributed wefts of hair 12 and more versatile hair styles of the hairpiece 3. In addition, lace ribbons 29, by increasing the base of the net lace cap 9, provide a stronger grasp of the head of the wearer 31 and a more stable hairpiece 3. The wearer will have the option of wearing a hairpiece 3 that covers the head of the wearer 31 partially or completely. In blending hair of the hairpiece 3 and hair of the wearer 30, hair of the hairpiece 3 (as shown in FIG. 1*b*) and hair of the wearer 30 (as shown in FIG. 4) are mingled together past the ends 6 of the headband 5, concealing the headband 5, while allowing the headband 5 to sit on the head of the wearer 31, and loosening the hair around the headband 5 for better styling. The hairpiece 3 is particularly designed to be worn easily and comfortably on top of the head of the wearer 31 and to increase hair of the top of the head of the wearer 31 where the hair decreases more frequently and to a larger extent. It is the hair 30 of the top of the head of the wearer 31 that is essential in defining a hairstyle. Therefore, the wearer of any hairpiece needs to concentrate on covering the top of his or her head. When the hair 30 of the top of the head is thinning and/or balding, any other section of hair on the head does not necessarily define a style. The hairpiece 3 can be designed in any style desired by the wearer: short, long, curly and/or straight. The hairpiece 3 can be made of human hair or of artificial hair and should preferably be of a color that blends well with the color of the hair of the wearer 30. Because the hairpiece 3 sits on top of the head of the wearer 31 and is secured with a headband 5, the hairpiece 3 will define the hair style of the wearer. Thus, the hairpiece 3 may act as a wig but retain the comfort and coolness of a wiglet.

The hairpiece 3 has a top side 2 (as shown in FIG. 1*a*) and a flexible bottom side 4 which forms the base of the hairpiece 3. The base of the hairpiece 3 is formed as a flexible net lace cap 9. Wefts of hair 12 make up the top side 2 of the hairpiece 3. The net lace cap 9 has a straight front edge 22, a curved back edge 23, a top side 19 and a bottom side 20 (refer to FIG. 1*a*). The net lace cap 9, which contributes most to shape of the hairpiece 3, may have different shapes but is preferably in shape of a semi-oval with a straight edge. When shaped as a semi-oval, the net lace cap 9 is widest at its front edge 22 and is narrowest at its back edge 23 in order to provide a larger amount of hair near the front edge 22 where hair of the wearer 30 is lost more rapidly and more frequently (as shown in FIG. 1*a*, FIG. 1*b*, FIG. 1*c* and FIG. 1*d*). Preferably, the front edge 22 of the net lace cap 9 rests near the forehead of the wearer and the back edge 23 of the net lace cap 9 rests near the crown of the wearer. Said semi-oval shaped net lace cap 9 has a central axis that is perpendicular to the front edge 22, with the central axis running from the crown of the head of the wearer 31 to forehead of the wearer. The bottom side 4 of the hairpiece 3 comprises the bottom side 20 of the net lace cap 9 and a strip of attaching material 25, preferably Velcro material. The top side 19 of the net lace cap 9 is similar to the bottom side 20 of the net lace cap 9. The net lace cap 9 is cut to the size of the top of the head of the wearer 31. The hair of the hairpiece 3 is attached to the top side 19 of the net lace cap 9 and, thus, hides the top side 19 of the net lace cap 9. The headband 5 meanwhile comprises a top side 7 and a bottom side 8 (please refer to FIG. 2*a* and FIG. 2*b*, respectively). With a loop strip 10 of attaching material attached to the bottom side 4 of the hairpiece 3 (and, therefore, to the bottom side 20 of the net lace cap 9) and a matching hook strip 11 of attaching material attached to the top side 7 of the headband 5, the hairpiece 3 is tightly secured to the head of the wearer 31 by using the headband 5. The top side 7 of the headband 5 is attached by means of the hook strip 11 to the bottom side 4 of the hairpiece 3. Therefore, chances of the hairpiece 3 slipping or unwantedly separating from the headband 5 are minimized and stability of the hairpiece 3 is maximized. The strip of attaching material 25 attached to the bottom side 4 of the hairpiece 3 is preferably a loop strip 10 (as shown in FIG. 1*a* and FIG. 1*c*) in order to minimize any tangling between a hook strip and the hair of the wearer 30 and the snarling of the hair of the hairpiece 3, especially during shampooing. Also, contact between a loop strip 10 and the head of the wearer 31 is less annoying than contact between a hook strip and the head of the wearer 31 in case of misplacement of the hairpiece 3. However, although inconvenient, use of a hook strip on the bottom side 4 of the hairpiece 3 and use of a loop strip on the top side 7 of the headband 5 is possible. The use of attaching material on the top side 7 of the headband 5 and on the bottom side 4 of the hairpiece 3 eliminates any need for using other holding means, including, but not limited to, adhesives, tapes, clips, pins, and/or combs, in order to fix the headband 5 to the hairpiece 3. (Please refer to FIG. 1*a* and FIG. 2*a*.) These other holding means can be uncomfortable, messy and/or ineffective on thin free hair.

A variety in length of the hair of the hairpiece 3 is allowed and does not affect the stability of the hairpiece 3. Wefts of hair 12 are attached to the top side 19 of the net lace cap 9 and extend out from the top side 19 of the net lace cap 9. (Please refer to FIG. 1*a*) The wefts of hair 12 may be sewn to form a variety styles of hairpieces 3 and may be sewn to the net lace cap 9 in order to extend in different directions, with bangs or without bangs, with short hair or with long hair, with curls or with straight hair, extending upward or downward, extending forward or backward, to name a few. Essential in construction of the hairpiece 3 is to design the base of the hairpiece 3 without hems around the net lace cap 9 and with loose edges 13, except at a section where any bangs would be positioned (please refer to FIG. 1*a*, FIG. 1*b*, FIG. 1*c* and FIG. 1*d*). Minimization of hems and maximization of loose edges 13 give the hairpiece 3 a more natural-looking positioning on the head of the wearer 31 and allow the wefts of hair 12 to stay loose and blend with any hair of the wearer 30. The loose-fitting hairpiece 3 with loose edges 13 provides coolness and comfort for the wearer. A wig tends to be hot due to the fact that the wig is worn so tightly on head of the wearer that passage of air on the scalp and, thus, dissipation of heat are minimized. Standard wiglets are cooler to the wearer than wigs are, but wiglets tend to be less natural-looking and are not as easily attached and styled. The loose edges 13 do not weaken the hairpiece 3 since the wefts of hair 12 are sewn to the net lace cap 9 and enough reinforcement is built into construction of the hairpiece 3 to avoid loss of shape of the hairpiece 3 during wearings and washings. The wefts of hair 12 are strong enough to avoid breakage due to and to endure normal wear and care. As a result, the hairpiece 3 tends to be flexible and to fit shape of the head of the wearer 31 easily and consistently. Meanwhile, the hairpiece 3 is worn by attaching the loop strip 10 of the hairpiece 3 to the matching hook strip 11 of the headband 5 without requiting any connecting means and is removed by pulling the loop strip 10 of the hairpiece 3 away from the hook strip 11 of the headband 5 without requiring any disconnecting means. Thus, by providing maximal coolness for the wearer, maximal stability of the hairpiece 3 and minimal discomfort and maximal speed in wearing and in removing the hairpiece 3, the hairpiece kit 1 presents maximal efficiency, comfort and convenience for the wearer. The ease of substitution of hairpieces 3 for one another and the possibility of use of artificial hair, as well as of natural hair, aid in minimizing costs of the hairpiece kit 1.

Existing headbands are either too long, too thick, too narrow and/or not shaped to fit comfortably around the head of the wearer 31 and/or to hold hairpieces of different shapes and sizes. An example of headbands wherein the size, particularly width, thickness and shape, of the headband is important are headbands that use hairpieces with sleeves attached to the bottom sides of the hairpieces. If the headband is too thick or too narrow, or if the headband is not in a shape that conforms to the shape of the sleeve, the hairpiece cannot be used with the headband. The length, width and shape of the present headband 5 are particularly designed to overcome some major disadvantages of headbands already existing in the market. Even though length, width and shape of a headband may seem trivial factors, in the present invention, the length, the width and the shape of the headband 5 play a major role in comfortability and effectiveness of the hairpiece kit 1. The headband 5 has a length determined by the distance across the head of the wearer 31 and between the ears of the wearer and has a shape to tightly and smoothly surround the top of the head of the wearer 31. Existing headbands have one end positioned slightly behind one ear of the wearer and another end positioned slightly behind another ear of the wearer. In contrast, the present headband 5 fits across the top of the head of the wearer 31, extending from just above one ear to just above the other ear, thus leaving any space behind the ear free for use by eyeglasses. In addition, the headband 5, by extending above the ears and by avoiding any contact with the ears, tends to be more comfortable. (Please refer to FIG. 4.) A headband that ends behind the ears of the wearer is usually uncomfortable, particularly for wearers who use eyeglasses, and tends to sit back enough on the head of the wearer 31 to affect the position of a hairpiece attached to the headband. Distortion in position of the headband results in distortion of the hairpiece and causes instability of the hairpiece. With the headband 5 designed to fit from above one ear to immediately above the other ear, the headband 5 can be hidden under the hairpiece 3 and the hairpiece kit 1 can be used by men, as well as by women. The headband 5 is designed to have tapering, and thus narrower, opposite ends 6 while having a wider central section 14 (as shown in FIG. 1*b*, FIG. 1*d*, FIG. 2*a*, FIG. 2*b*, FIG. 3 and FIG. 4) which is placed on top of the head of the wearer 31 when the headband 5 is positioned on the head of the wearer 31. The narrower, tapering opposite ends 6 of the headband 5 can be hidden more easily under the hairpiece 3 and facilitate blending of hair of the wearer 30 with the hair of the hairpiece 3 at the ears of the wearer. In addition, the headband 5 can be made in different colors to more smoothly blend with haircolor of the wearer. The headband 5 is slim, flat and easily bent and is made of reinforced plastic. Presently available plastic bands tend to loose their shape and tensile strength with wear. In a most preferred embodiment, the central section 14 of the headband 5 has a width of approximately one inch.

The headband 5 has a number of rows of gripping teeth 15 (please refer to FIG. 1*b*, FIG. 1*d*, FIG. 2*b* and FIG. 3). Said gripping teeth 15 preferably have a length of about 1/16" each and are attached to the bottom side 8 of the headband 5. In a preferred embodiment, the gripping teeth 15, being positioned on the bottom side 8 of the headband 5, provide a means for increasing the stability of and minimizing the movement of the hairpiece 3 on the hair of the wearer 30 while minimizing any discomfort for the wearer. Meanwhile, by slightly lifting the hairpiece 3 from the head of the wearer 31, the headband 5 provides a cooler hairpiece kit 1 for the wearer. Most other wigs are generally hot to wear since each wig must fit tightly around the head of the wearer 31 to avoid slippage of the wig.

In a preferred embodiment, hook strips 11 of the attaching material are sewn onto the headband 5 (sewn hook strips 11 not shown in the drawings). Sewn hook strips 11 on the headband 5 provide a more secure hold than adhesives, tapes, clips, pins or combs do. As a result, the furnished headband 5 is more durable and has a neater appearance than headbands already existing in the market. Similarly, the loop strip 10 can be sewn onto the bottom side 4 of the hairpiece 3 (and, therefore, to the bottom side 20 of the net lace cap 9).

Figure 5:
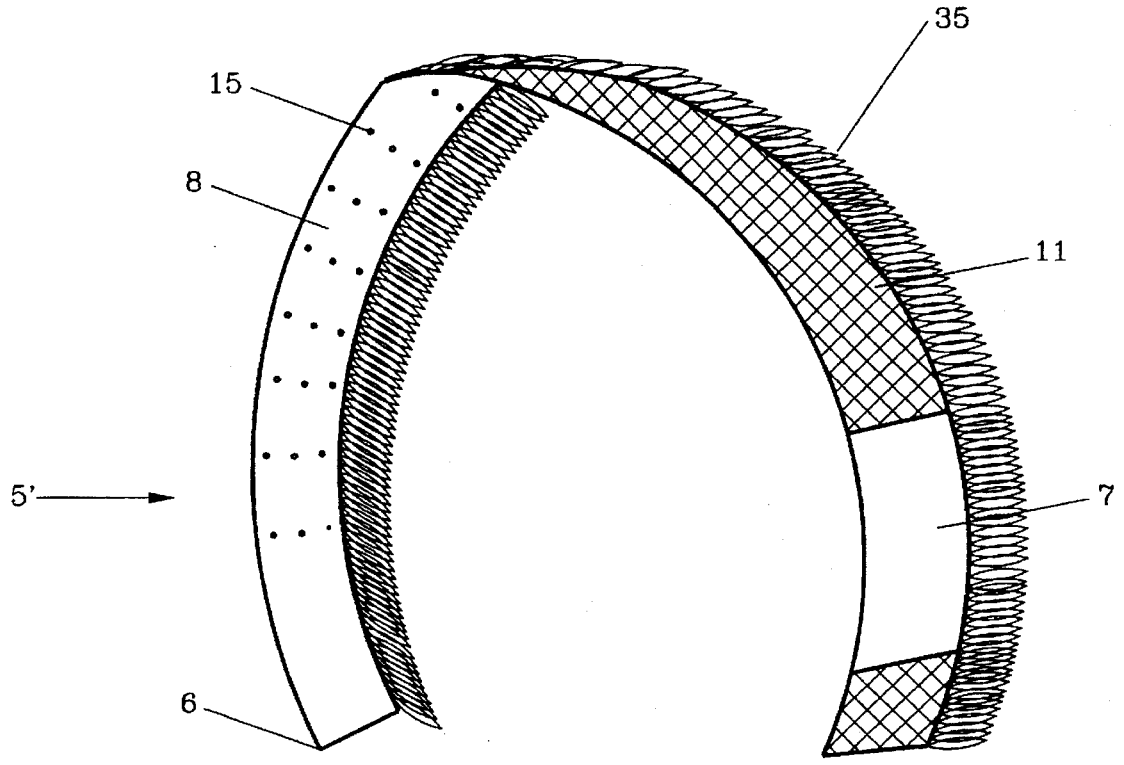
FIG. 5 illustrates a perspective view of a comb-style headband with a hook strip attached to the top of the headband, a number of rows of gripping teeth attached to the bottom of the headband and a row of comb tangs positioned along the length of the headband.

Another version of the hairpiece kit 1 uses a headband 5' with tangs 35 (refer to FIG. 5). The headband 5' with tangs 35 is a headband 5' in the form of a large curved comb and can be used by wearers who have some natural hair remaining. The comb-style headband 5' has a strip of hook material 11 attached to the top side 7. Any number of tangs 35 may extend along any desired portions of the headband 5'. The tangs 35 of the headband 5' are inserted into any remaining natural hair of the wearer 30 and, thus, add to the stability of the headband 5'. When inserted into the remaining hair of the wearer 30, the tangs 35 can be pointing towards the crown or towards the forehead of the wearer. Other components of the hairpiece kit 1 remain unchanged. For example, any desired number of rows of gripping teeth 15 continue to be used at the bottom side 8 of the headband 5'. There are no changes in the hairpiece 3.

Figure 6:
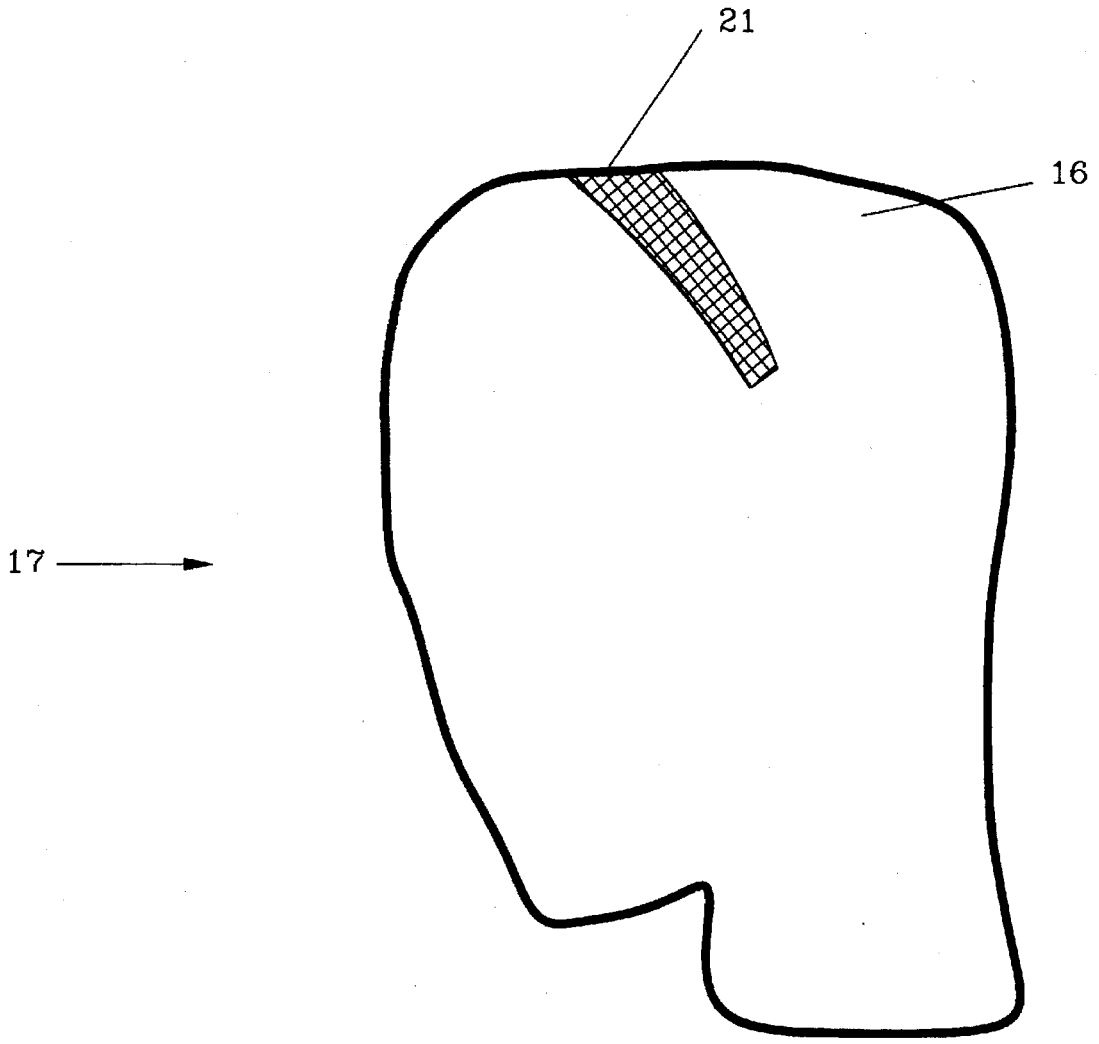
FIG. 6 is a schematic side view of a headform with a hook strip.

In addition, a hook strip 21 of attaching material is used on a headform 17 (as shown in FIG. 6) for storing and styling the hairpiece 3. The hook strip 21 of attaching material of the headform 17 is approximately 4 inches long and is attached on top 16 of the headform 17. The hairpiece 3 with the headband 5 is removed from the head of the wearer 31. The hairpiece 3, having a loop strip 10 of attaching material is removed from the headband 5 and is positioned and attached to the hook strip 21 on the headform 17. The hairpiece 3 is held strongly enough on the headform 17 to avoid any slippage of the hairpiece 3 during storage and styling. In the past, hairpieces have been stored by using pins to secure the hairpiece. When pins are used to secure the hairpiece, shape of the hairpiece can be distorted. Combing, brushing and styling of the hairpieces are more difficult and time-consuming. Using the hook strip 21 of attaching material connected to the headform 17 to hold the hairpiece 3 eliminates any need for seeming the hairpiece 3 with pins, thus diminishing any distortion in the shape and style of the hairpiece 3. In addition, pins that are presently used to connect hairpieces to headforms will no longer be a nuisance during combing and brushing of the hairpiece 3 for styling.

Certain objects are set forth above and made apparent from the foregoing description and examples. However, since certain changes may be made in the above description and examples without departing from the scope of the invention, it is intended that all matters contained in the foregoing description and examples shall be interpreted as illustrative only of the principles of the invention and not in a limiting sense. With respect to the above description and examples then, it is to be realized that any descriptions and examples deemed readily apparent and obvious to one skilled in the art and all equivalent relationships to those stated in the examples and described in the specification are intended to be encompassed by the present invention.

Further, since numerous modifications and changes will readily occur to those skilled in the art, it is not desired to limit the invention to the exact construction and operation shown and described and, accordingly, all suitable modifications and equivalents falling within the scope of the invention may be resorted to. It is also to be understood that the following claims are intended to cover all of the generic and specific features of the invention herein described, and all statements of the scope of the invention which, as a matter of language, might be said to fall therebetween.

What is claimed as invention is:

1. A hairpiece kit, designed to cover any bald spots of and to provide thick hair for head of a wearer, comprising:

a. a hairpiece comprising:

(i) a top side including wefts of hair of any desired style, texture and color, (ii) a flexible bottom side, (iii) a flexible net lace cap having a top side, a bottom side, and unhemmed, loose edges including a front edge and a back edge, with the wefts of hair being attached to, extending out in any desked direction from and hiding the top side of the net lace cap, with the loose edges giving the hairpiece a more natural-looking positioning on the head of the wearer, and with a central axis being perpendicular to its front edge and running from crown of the head of the wearer to forehead of the wearer, and (iv) a strip of attaching material being attached to the bottom side of the net lace cap and, along with the bottom side of the net lace cap, forming the bottom side of the hairpiece;

b. a flexible headband, extending from above one ear of a wearer to above another ear of the wearer when worn and supporting the hairpiece, said headband comprising:

(i) a central section and two opposite ends that are narrower than the central section, with the central section being positioned on top of head of the wearer, with each end being positioned above a corresponding ear of the wearer without contacting the corresponding ear, and with the wefts of hair of the hairpiece covering and hiding each end, (ii) a top side, (iii) a bottom side, (iv) a strip of attaching material attached to the top side of the headband and matching the strip of attaching material attached to the bottom side of the hairpiece, and (v) a number of rows of gripping teeth positioned on and attached to the bottom side of the headband;

wherein the hairpiece is worn by attaching the strip of attaching material of the bottom side of the hairpiece to the matching strip of attaching material of the top side of the headband without using any separate connecting means, and wherein the hairpiece is removed by pulling the strip of attaching material of the bottom side of the hairpiece from the matching strip of attaching material of the top side of the headband without using any separate disconnecting means.

2. The hairpiece kit of claim 1 wherein the headband is made of reinforced plastic in order to avoid, due to wear, loss of shape and loss of tensile strength of the headband.

3. The hairpiece kit of claim 1 wherein the central section of the headband has a width of approximately one inch.

4. The hairpiece kit of claim 1 wherein the same headband, having a length, width, thickness and shape adjusted to facilitate use by and maximize comfort for the wearer, can be used during removal and replacement of the hairpiece without necessitating removal of the headband, speeding up removal and replacement of the hairpiece.

5. The hairpiece kit of claim 1 wherein a loop strip of attaching material is attached to the bottom side of the hairpiece and a matching hook strip of attaching material is attached to the top side of the headband, securing the hairpiece to the head of the wearer and minimizing any tangling between hair of the wearer and the hairpiece.

6. The hairpiece kit of claim 1 wherein each gripping teeth of the number of rows of gripping teeth has a length of about 1/16 inches to minimize slippage of the hairpiece on the head of the wearer while minimizing any discomfort for the wearer.

7. The hairpiece kit of claim 1 wherein the net lace cap is shaped as a semi-oval and the front edge of the unhemmed, loose edges of the net lace cap is straight and is positioned near the forehead of the wearer and the back edge is curved and is positioned near the crown of the head of the wearer, with the net lace cap being widest at its front edge and being narrowest at its back edge in order to provide a larger mount of hair near the front edge where hair is lost more rapidly and more frequently.

8. The hairpiece kit of claim 1 wherein flexible lace ribbons extend out from the net lace cap, providing increased and a more spread-out base that supports an increased amount of and more evenly-distributed wefts of hair.

9. The hairpiece kit of claim 1 wherein the headband is shaped like a large curved comb, with the central section and the two ends of the headband extending into a number of tangs, said headband being usable by hairpiece users who have some natural hair remaining.

10. The hairpiece kit of claim 1 wherein the hairpiece kit includes a headform, with a hook strip serving as a matching strip of the loop strip of the hairpiece and attached to top of the headform, such that upon removal of the hairpiece from the headband on the head of the wearer, the hairpiece is connected to the hook strip attached to the headform and is held strongly and with minimal movement on top of the headform, avoiding any slippage of the hairpiece during storage and styling.

11. The hairpiece kit of claim 10 wherein the hook strip connected to the headform is approximately 4 inches long.

12. The hairpiece kit of claim 1 wherein the same headband can be used with different hairpieces, cutting costs of using different headbands for each hairpiece of different dimensions.

* * * * *